United States Patent [19]

Yates, Jr. et al.

[11] Patent Number: 4,522,665

[45] Date of Patent: Jun. 11, 1985

[54] PRIMER MIX, PERCUSSION PRIMER AND METHOD FOR INITIATING COMBUSTION

[75] Inventors: Donald N. Yates, Jr.; Michael Oestrich, both of Katy, Tex.

[73] Assignee: GEO Vann, Inc., Houston, Tex.

[21] Appl. No.: 587,344

[22] Filed: Mar. 8, 1984

[51] Int. Cl.[3] ..... C06B 45/02

[52] U.S. Cl. ..... 149/21; 149/2; 149/42; 149/113; 149/114; 149/76; 149/77; 102/204

[58] Field of Search ..... 149/2, 21, 42, 113, 149/114, 76, 77; 102/204

[56] References Cited

U.S. PATENT DOCUMENTS 3,914,143 10/1975 Sterling ..... 149/42 X

OTHER PUBLICATIONS

Don Yates Letter Dated Jul. 16, 1981 to Colle, with 6 attached drawings.

Blueprint No. X51-1965, on High Temperature Percussion Detonator.

Barbara Taylor, Letter Dated Mar. 15, 1982 to Larson, with 3 Attached Purchase Order Sheets.

Peck, Cox and Yates, Report Dated Jul. 23, 1982 Entitled Final Report on Assembly and Test of the Design for 10-Second Delay Device.

Oestreich and Smith, Report Dated Feb. 16, 1983 Entitled Final Report on Development Testing of the 51-2592-1, Core Gun Cartridge.

*Primary Examiner*—Stephen J. Lechert, Jr.

*Attorney, Agent, or Firm*—Curtis, Morris & Safford

[57] ABSTRACT

A primer mix which contains from 26 to 66 weight percent titanium and from 74 to 44 weight percent potassium perchlorate having a density of from 68 to 81 percent of crystal density such that the mix is stable at high temperature up to 525° F. for more than 100 hours without degradation and requires a relatively high amount of impact energy greater than 4 ft.-lbs. in order to ignite it. Alternatively, the primer mix contains from 40 to 74 weight percent zirconium and from 60 to 26 weight percent potassium perchlorate having the above density. The primer mix is used in a percussion primer for initiating combustion or in a percussion initiator for detonating a high-order explosive, as used for example within wellbores in the oil and gas industry.

19 Claims, 2 Drawing Figures

PRIMER MIX, PERCUSSION PRIMER AND METHOD FOR INITIATING COMBUSTION

FIELD OF THE INVENTION

The field of this invention is initiation of ignition of low explosives and/or detonation of high explosives, as used for example within wellbores in the oil and gas industry.

BACKGROUND OF THE INVENTION

Explosives are substances capable of exerting, by their characteristic high-velocity reactions, sudden high pressures. Chemical explosives are divided into two main categories, the "low-order" or "deflagrating" type and the "high-order" or "detonating" type. The latter are further classified as "primary" or "secondary" detonating explosives.

Deflagrating explosives are characterized by a reaction rate which increases nearly in direct proportion to the pressure (as a result of the influence of pressure on surface temperature), but always remains one or two orders of magnitude lower than the reaction rate in the detonating type. The explosion typically moves through the unexploded material at a speed slower than that of sound in that material. The limiting rate of reaction and pressure in granular low explosive is determined by the effective burning surface and the upper limit of surface temperature. The pressure-time curve of a deflagrating explosive tends to exhibit a maximum usually below about 75,000 psi and normally around 50,000 psi.

In contrast, detonating explosives are characterized by an explosive process in which the reaction takes place within a high-velocity shock wave known as the "detonation wave" or "reaction shock." This wave generally propagates at a constant velocity, typically faster than the speed of sound in that material, depending on the chemistry of the explosive, its density and its physical state. Pressures generated by detonation range from about 1.5 million to 4.5 million psi.

Primary detonating high explosives are used to detonate other high explosives. The reaction in a primary explosive is initiated by heat or shock waves, and such explosives are extremely dangerous because of their high sensitivity. They first burn or deflagrate for a few micro-seconds, then detonate.

Secondary detonating high explosives produce the largest amounts of energy. Without initiation by a primary high explosive, they are relatively stable. Detonation of the explosive depends on its confinement, the rate of heat dissipation, and the nature of the explosive itself.

There are a variety of chemical explosive compounds, each one with characteristics that determine the conditions under which it can advantageously be used. Accordingly, a particular explosive compound may be more desirable for use in one situation than in another, a different explosive compound being better suited for use under the latter situation's conditions. However, all types of explosives have at least one characteristic in common: they require some sort of activation, by application of externally supplied means such as heat, flame, electrical discharge, impact or shock, to initiate the explosive reaction. It nonetheless confirms their diversity that sensitivity to the aforementioned stimulus varies from one explosive to another, and varies even for a given explosive under different conditions of temperature, pressure, concentration, density and physical state.

Explosive charges, both of the deflagrating and detonating type, are utilized for various functions in the oil and gas industry; one frequent use is for perforating a well casing to complete or test a formation, and another is for setting a packer or other device downhole in a wellbore. Due to the time and the expense involved in carrying out such operations and the explosive power of the compounds, it is essential that the performance of the explosives be reliable. Furthermore, it is important that explosive materials be resistant to the extremes of temperature encountered in the typical wellbore environment because such conditions can degrade the operation of the explosive materials.

Because of the difficulty in setting up and maintaining electrical means connected to an explosive charge to cause electrical initiation of an explosion within the wellbore—due largely to its depth—it is desirable to ignite low-order explosives and detonate high-order explosives by an initial deflagrating explosive charge which is actuated by impact. However, that percussive actuation also poses problems. Deflagrating explosives which are known to ignite upon impact and therefore might be utilized as initiators, such as those generally used to fire bullets and other projectiles, including lead thiocyanates and barium styphnates, contain organic moieties which introduce instability under extremes of temperature over periods of time. Furthermore, such compounds are extremely sensitive, igniting upon an impact of only 1 to 20 inch-ounces. That sensitivity could well cause premature firing of the explosive under the harsh conditions within the wellbore, with the result that the wellbore would be damaged so as to require difficult repairs or even permanent closure.

Other percussion-activated explosives used in the oil and gas industry, such as lead azide and lead styphnate, also are extremely sensitive to impact ignition and show poor stability at various extremes of temperature.

As a result of the shortcomings of known percussive primer mixtures, the art would ordinarily be inclined to utilize instead the aforementioned electrically initiated primers. One such primer contains a mixture of titanium and potassium perchlorate. Thus, in a percussive primer the mixture of titanium and potassium perchlorate would typically be disposed in cooperation with an electrical heating element, which element imparts heat energy to the mixture causing it to ignite (for instance, at around 750° F.). Compaction of the titanium and potassium perchlorate mixture is unnecessary to and does not in any appreciable manner improve the essential capacity of the mixture to function as a primer. While in practice the mix is compacted at a pressure of around 15,000 psi to a density of around 2.2 g/cc, this is done only so that 1 watt of heat, a value often incidentally encountered in operation, can safely flow through the heating element and be dissipated without igniting the primer mix. Increasing the heating power input to around 5 watts will provide sufficient heat to ignite the primer mix.

However, as previously explained, the disadvantage of electrical ignition discourages the use of such mixture in their known physical state in applications within wellbores.

Provision of a percussion primer and primer mix which confer on the art the advantages accruing with use of a percussion primer, but eliminate the previously discussed problems associated with known percussion primer mixes, would be a highly desirable advance over the current state of technology.

OBJECTS OF THE INVENTION

It is an object of this invention to provide a deflagrating primer mix which is stable at high temperature and not unduly sensitive to moisture.

It is also an object of this invention to provide a primer mix which is relatively insensitive to impact and requires input of a relatively high amount of impact energy in order to ignite it.

It is an additional object of this invention to provide a percussion primer mix which allows a high measure of control downhole in a wellbore.

It is a further object of this invention to provide a primer mix which can be activated without use of electrical discharge, direct heating, or fuses which necessitate the use of wiring or other connectors between the primer mix within the wellbore and the ground surface.

It is still a further object of this invention to provide a primer mix, having the previously mentioned advantages, in a percussion primer for initiating combustion and/or detonation.

It is yet another object of this invention to provide a primer mix, having the previously mentioned advantages, in a detonation initiator.

It is still another object of this invention to provide a method for making the primer mix of the invention.

And, it is one more object of this invention to provide a method of using the primer mix to initiate a detonation reaction in high explosive material and thereby attain the objects and advantages described above.

These and other objects and advantages of the present invention will become more readily apparent after consideration of the following.

STATEMENT AND ADVANTAGES OF THE INVENTION

The present invention is directed, inter alia, to (as an article of manufacture) a primer mix, which comprises a compacted mixture of a fuel component and an oxidizer component that requires an impact energy greater than 4 ft.-lbs. to ignite it when housed in a final assembly.

In one of its aspects, the invention is directed to (as an article of manufacture) a primer mix, which comprises from 26 to 66 weight percent titanium and from 74 to 44 weight percent potassium perchlorate and is from 68% to 81% of crystal density (i.e., the density is from 2.1 to 2.5 g/cc) such that the mix is stable at least up to, and often above, 525° F. and is ignited upon an impact greater than 4 ft.-lbs. when housed in a final assembly. Preferably, the density of the mix is from 75% to 81% of crystal density (i.e., the density is from 2.3 to 2.5 g/cc) such that the mix is ignited upon an impact greater than 6 ft.-lbs. when housed in a final assembly.

In another aspect, the invention is directed to the above-described primer mix in a percussion primer suitable for initiating combustion of a low-order explosive, which primer includes a housing for the mixture.

In still another aspect, the invention is directed to the above-described primer mix in a device suitable for initiating detonation of a high-order explosive, which device includes a housing for the mixture.

In yet another aspect, the invention is directed to a method of making a pyrotechnic mixture of titanium and potassium perchlorate, which method minimizes the chances of its premature ignition.

In a further aspect, the invention is directed to a method of using the primer mix described above for initiating combustion or detonation of an explosive brought into association with the ignited primer mix.

Numerous advantages accrue with the practice of the present invention.

The above-described primer mix, e.g. a mixture of titanium and potassium perchlorate at a density of from 2.1 to 2.5 g/cc, is advantageous in that it will ignite only upon an impact of over 4 ft.-lbs. when housed in the final assembly. It is not unsuitably sensitive as are other known impact-initiated deflagrating explosives. Further, unlike other commercially available percussion primer mixes, the present titanium and potassium perchlorate article of manufacture remains stable up to 525° F. for more than 100 hours without degradation and will not self-ignite up to around 900° F. for 5 seconds.

Thus, the invention provides a primer mix, such mix within a percussion primer, such mix within a detonation device, a method of making that mix and a method for utilizing same to initiate combustion or detonation, ideally suited for solution of the operational problems resulting from the extreme temperatures and otherwise harsh conditions which exist in wellbores. In the following section, the invention is described in greater detail to illustrate several of its embodiments.

DESCRIPTION OF CERTAIN PREFERRED EMBODIMENTS

Figure 1:
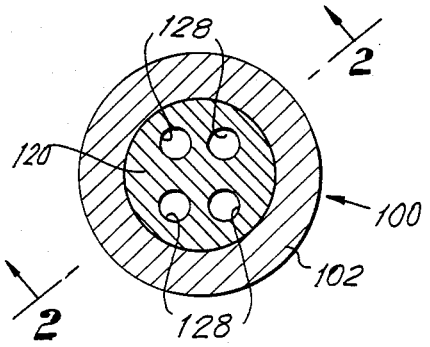
FIG. 1 is a cross-sectional view of a final assembly suitable for housing the primer mix of the present invention.

The combination of titanium and potassium perchlorate constitutes a pyrotechnic mixture, that is, a combination of fuel and oxidizer that produces high heat and pressure upon ignition. Titanium acts as the fuel and potassium perchlorate the oxidizer; upon oxidation, the fuel releases energy to initiate further combustion of the remaining unreacted mixture.

The blend of the two inorganic materials titanium and potassium perchlorate is ideally suited for high temperature applications since the mixture does not undergo any crystal phase changes with increased temperature until 570° F. at which time the potassium perchlorate changes from a rhombic to a cubic crystal structure. The main exotherm (the point at which the mixture begins to auto-ignite) of a 41% by weight titanium and 59% by weight potassium perchlorate mixture, wherein there is a slight excess amount of oxygen to react with the fuel, starts at 887° F.

Equivalent oxidizers can be used in place of the potassium perchlorate such as, for example, ammonium perchlorate or lithium perchlorate. However, ammonium perchlorate undergoes a phase change at around 350° F., which change in crystal form causes unpredictable results above that temperature. Due to the phase change, the mixture may self-ignite or not ignite at all above that temperature. Below about 350° F., though, a mixture of titanium and ammonium perchlorate compacted from 70 to 85% of crystal density can be used with reliability and predictability. A mixture of titanium and lithium perchlorate is stable and predictable at higher temperatures than either a mixture of titanium and potassium perchlorate or ammonium perchlorate, but has the disadvantage that such mixture is hygroscopic and therefore not suitable for use in environments containing significant amounts of moisture. However, such a combination according to the present invention could be used advantageously in low-moisture environments.

As a fuel, zirconium can be directly substituted for titanium. The main exotherm of a 57% by weight zirconium and 43% by weight potassium perchlorate mixture, wherein there is a slight excess amount of oxygen available to react with the fuel, starts at 842° F. Iron can also be substituted, but results in a lower energy reaction.

The fuel in the primer mix is included in an amount sufficient to cause the necessary release of energy to propogate the explosion and initiate the ignition of low-order explosives or the detonation of high-order explosives. The oxidizer is included in an amount sufficient to provide the necessary oxygen for the explosive reaction. Preferably, the primer mix comprises from 26 to 66 weight percent titanium and from 74 to 44 weight percent potassium perchlorate. It is especially preferred that the primer mix comprise from 39 to 43 weight percent titanium and from 61 to 57 weight percent potassium perchlorate such that there is an excess amount of oxygen available to react with the fuel. Alternatively, the primer mix comprises from 40 to 74 weight percent zirconium and from 60 to 26 weight percent potassium perchlorate. It is especially preferred that the primer mix comprise from 55 to 59 weight percent titanium and from 45 to 41 weight percent potassium perchlorate such that there is an excess amount of oxygen available to react with the fuel.

Ideally, the fuel should be thoroughly mixed with the oxidizer to maximize the contact between the fuel and the oxidizer. Typically, the fuel and oxidizer components are in particulate form in order to effect sufficient contact, particle size being selected to obtain the necessary degree thereof.

Advantageously, the primer mix is prepared from powdered titanium and powdered potassium perchlorate. A particle size of from 1 to 3 microns for titanium and of less than 10 microns for potassium perchlorate provides an oxidizer of sufficient surface area to ensure that the fuel is beneficially brought into contact with the oxidizer. Even more advantageous, in situations where economies of cost are not an overriding factor, is the use of a gradient of particle sizes for the titanium and potassium perchlorate to facilitate contact of the particles.

The primer mix is prepared by mixing powdered titanium and powdered potassium perchlorate (which powders have the desired particle sizes) in any manner which results in the desired degree of contact, preferably in a ball mill in the presence of a fluid constituent such as, for example, isopropyl alcohol. Alternatively, the two powders can be tumbled together with rubber stoppers, also in the presence of a fluid medium such as isopropyl alcohol. In either case, when a homogenous mixture of the powders is obtained, the combined mixture and fluid media are separated, for instance by spreading a mass of the combination in order to facilitate evaporation of the fluid medium and vacuum drying to yield a dry, homogenous mixture of titanium and potassium perchlorate.

The mix is then compacted to a density sufficient to allow the mix to ignite upon impact and to impart temperature- stability to the mix. A density of from 68% to 81% of crystal density yields a compacted mix which ignites upon a minimum impact greater than 4 ft.-lbs. and is stable to 500° F. for more than 100 hours without degradation. It is preferred that the density be from 75% to 81% of the crystal density to provide a compacted mix which ignites upon a minimum impact of 6 ft.-lbs. when housed in a device suitable for initiating combustion and/or detonation. Such a device is described in more detail in a following portion of this specification and in the accompanying figures of drawing, as well as in U.S. application Ser. No. 587,345 entitled Pressure Responsive Explosion Initiator with Time Delay and Method of Use, filed on even date herewith and assigned to the assignee of the present application. The subject matter of that application is hereby incorporated by reference.

To achieve a density of from 2.1 to 2.5 g/cc, the primer mix of 41% by weight titanium and 59% by weight potassium perchlorate is subjected to a compaction pressure of from 10,000 to 50,000 psi. To achieve a density of from 2.3 to 2.5 g/cc, the primer mix is subjected to a compaction pressure of from 15,000 to 50,000 psi. Compaction is accomplished by pressing the powder with a ram at a hold time of approximately seven seconds, or by any other known method of consolidation of powder particles which provides the requisite amount of compaction pressure.

The compaction pressure necessary to obtain the required density (and, thus, the desired sensitivity to impact) in any given specific combination of titanium, zirconium or iron fuel and potassium perchlorate, ammonium perchlorate or lithium perchlorate oxidizer will depend on the chemistry of the mixture, i.e., the relative constituent proportions of fuel and oxidizer and the particular fuel and oxidizer used, as well as the particle size of the fuel and oxidizer components and the specific design of the aforementioned housing for the device. One skilled in the art will be able to adapt known methods of compaction to achieve the particular density needed to yield the desired sensitivity to impact.

The use of too great a compaction pressure, and therefore the attainment of too high a density for the pyrotechnic mixture, will result in a primer mix that is difficult to ignite upon impact. For example, a compaction pressure above 70,000 psi yields a primer mix near crystal density that does not ignite with reliability or predictability upon impact, or may not ignite at all upon impact.

Too low a compaction pressure, and hence too low a density, may result in a primer mix having an excess amount of voids which contain ambient atmosphere and/or contaminants released by other explosive materials disposed in the locale of the primer mix, which will tend to degrade the primer mix through contact with it. That result is obviously undesirable in that it will lead to erratic and undependable firing.

Compaction pressure in the aforementioned range of 10,000 to 50,000 psi yields a desired density such that the pyrotechnic mixture will actuate upon an impact of around 4 to 10 foot-pounds. Especially preferred for wellbore applications is a compaction pressure of from 15,000 to 50,000 psi such that the sensitivity of the primer mix will decrease and an impact of six foot-pounds or more will be required to actuate the explosive when housed in the aforementioned device suitable for initiating combustion and/or detonation.

Figure 2:
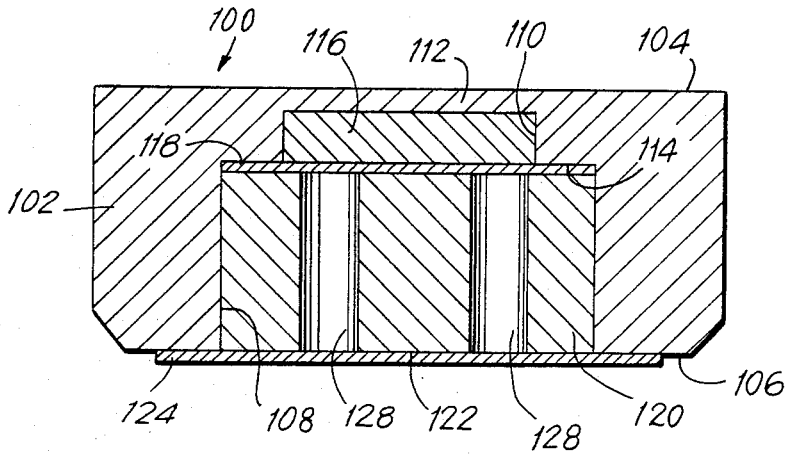
FIG. 2 is a partially cross-sectional view taken along line 2—2 in FIG. 1.

A detailed description of devices suitable for housing the primer mix appears from the following text and FIGS. 1 and 2. As an example, the primer mix according to the invention can be used in a percussion primer for initiating a deflagration combustion. The percussion primer assembly 100 includes a generally cylindrical primer cup 102 having an upper flat surface 104 and a lower flat surface 106. The lower flat surface 106 has a concentric, cylindrical bore 108 formed therethrough toward the upper flat surface 104. A concentric, cylindrical counterbore 110 also is formed in cup 102 from an upper boundary of bore 108 and terminating a short distance from upper surface 104, thus to form a thin wall or web 112 therebetween. The counterbore 110 forms an annular shoulder 114 at the upper boundary of the bore 108. The primer cup 102 may be made, for example, of stainless steel. Such percussion primer is described in even greater detail in the United States Application entitled Pressure Responsive Explosion Initiator with Time Delay Method of use, which application is more fully identified (and incorporated by reference) above.

The counterbore is filled with the primer mix 116 preferably compacted in the counterbore. A stainless steel closure disc 118 is positioned against annular shoulder 114 to retain the primer mix 116 in counterbore 110. A cylindrically shaped stainless steel anvil 120 is positioned within bore 108 to press disc 118 upwardly against shoulder 114, the lower surface 122 of the anvil 120 being flush with the lower flat surface of the cup 106.

The thickness of the web 112 and the depth of the counterbore 110, together with the compaction of the primer mix 116, are selected to achieve the desired impact sensitivity. That is, as the thickness of web 112 is increased, impact sensitivity of the primer mix 116 in the assembly 100 is decreased, and as the depth of counterbore 110 is increased, so likewise is the impact sensitivity decreased. Moreover, as the density of the primer mix is increased (by increasing the compaction pressure), so also is the impact sensitivity lowered. In the disclosed embodiment, the thickness of the web 112 is nominally 0.011 inch thick and the depth of the counterbore 110 is nominally 0.035 inch deep. Where the primer mix is compacted from 68% to 81% of crystal density in this housing, an impact sensitivity in excess of 4 ft.-lbs. is achievable. As will be appreciated by those of ordinary skill in the art, the foregoing embodiment is by no means the only one which is suitable for practicing the invention; with the aid of the information set forth herein, appropriate variation of the dimensions, configuration, materials and the like of the housing assembly to obtain a desired impact sensitivity will be well within the skill of the art.

Thus, in use, the projection of a firing pin strikes the web 112 of the percussion primer assembly to deform it inwardly, forcing the primer mix 116 against the anvil 120 to ignite it. The web is made sufficiently thin so that it will be deformed adequately by the impact of the projection to ensure ignition. The anvil 120 is provided with four longitudinally extending openings 128 therethrough. After the thin closure 118 is shattered by hot ignition gas, four jets of that gas pass through those openings (along with steel particles from disc 118) to provide a means of igniting a flash-sensitive, first-fire explosive mix, such as AlA.

It is especially preferred that a second closure disc 124, preferably stainless steel, is spot welded or otherwise adhered to the lower flat surface 106 of the primer cup 102 to support the anvil 120 within the cup and to provide a hermetic seal to protect the primer mix 116 against moisture and prevent contamination and degradation of the primer mix. Upon ignition, the hot gas shatters the thin closure disk 124 and steel particles from the disk are carried with the hot ignition gas to aid ignition of the first-fire mix.

The percussion primer assembly with the titanium and potassium perchlorate primer mix can be used in apparatus for detecting firing of a perforating gun within the wellbore as described in U.S. application Ser. No. 505,911, filed June 20, 1983 and assigned to the assignee of this application. The subject matter of that application is also incorporated by reference herein.

Additionally, the primer mix can be used in a percussion initiator for detonating a high-order explosive by heat or impact, which detonation optionally further detonates a secondary high explosive. In such an embodiment, the primer mix is disposed in a percussion primer subcombination as already described which is commonly housed and operatively associated with a primary high explosive, such as, for example, lead azide. Upon ignition of the primer mix by striking its housing with a firing pin, hot gases and particles originating from a closure disk containing the primer mix contact the primary high explosive to initiate a detonation of the primary high explosive. Such primary high explosive optionally further initiates the detonation of a secondary high explosive which is commonly housed and operatively associated with the primary high explosive.

Further objects of the invention, together with additional features contributing thereto and advantages accruing therewith, will be apparent from the following example of the invention.

EXAMPLE 41 parts by weight of titanium powder and 59 parts by weight of potassium perchlorate powder were admixed and 50 mg of that mix charged into the cup of a housing assembly as illustrated in FIGS. 1 and 2. The assembly had a web thickness of 0.025 inches, and the counterbore was 0.068 inches deep and 0.161 inches in diameter. The mix was then subjected to a compaction pressure of 40,000 psi, by pressing it while in the cup with a pneumatic ram for several seconds. The compacted material had a density of 2.5 g/cc. When the compacted primer mix in the housing assembly was subjected to an impact of 10 ft.-lbs. at room temperature, 100% all-fire was achieved. However, when the mixture had previously been subjected to a 7 ft.-lb. impact force at room temperature, there was no ignition at all. Those results demonstrate the distinct advantages—that is, the concurrent firing-predictability and elimination of undue sensitivity—which accrue to the practitioner of the invention.

In related testing, even when similarly made primer mix units were subjected to 450° F. for 200 hours those units still ignited completely and predictably when struck with an impact of 10 ft.-lbs.

While the invention has been described with reference to specific embodiments, it would be understood by those skilled in the art that a range of chemistries may be employed and equivalents may be substituted for elements thereof without departing from the scope of the invention. The terms and expressions which have been employed are used as terms of description and not of limitation and there is no intention in the use of such terms and expressions of excluding any equivalents of the features shown and described or portions thereof, it being recognized that various modifications are possible within the scope of the invention.

We claim:

1. As an article of manufacture a primer mix, which consists essentially of from 26 to 66 weight percent titanium and from 74 to 44 weight percent potassium perchlorate having a density of from 2.1 to 2.5 g/cc.

2. A primer mix as defined in claim 1, wherein the mix is stable up to 525° F. for 100 hours without degradation and is ignited upon an impact greater than 4 ft.-lbs.

3. A primer mix as defined in claim 1, wherein the density is from 2.3 to 2.5 g/cc such that the mix is ignited upon an impact greater than 6 ft.-lbs.

4. A primer mix as defined in claim 1, wherein the titanium is in the form of particles of from 1 to 3 microns in diameter and the potassium perchlorate is in the form of particles less than 10 microns in diameter.

5. A primer mix as defined in claim 1, wherein the amount of titanium is from 39 to 43 weight percent and the amount of potassium perchlorate is from 61 to 57 weight percent.

6. A primer mix as defined in claim 5, wherein the density is from 2.3 to 2.5 g/cc such that the mix is ignited upon an impact greater than 6 ft.-lbs.

7. A primer mix as defined in claim 5, wherein the titanium is in the form of particles of from 1 to 3 microns in diameter and the potassium perchlorate is in the form of particles less than 10 microns in diameter.

8. In a percussion primer for initiating combustion, a primer mix which consists essentially of a mixture of from 26 to 66 weight percent titanium and from 74 to 44 weight percent potassium perchlorate, said mix having a density of from 2.1 to 2.5 g/cc; and a housing for the mixture.

9. A primer mix as defined in claim 8, wherein the density is from 2.3 to 2.5 g/cc.

10. A primer mix as defined in claim 9, wherein the titanium is in the form of particles of from 1 to 3 microns in diameter and the potassium perchlorate is in the form of particles less than 10 microns in diameter.

11. In a percussion initiator for detonating a high-order explosive, a primer mix which consists essentially of a mixture of from 26 to 66 weight percent titanium and from 74 to 44 weight percent potassium perchlorate, said mix having a density of from 2.1 to 2.5 g/cc; and a housing for the mixture.

12. A primer mix as defined in claim 11, wherein the density is from 2.3 to 2.5 g/cc.

13. A primer mix as defined in claim 12, wherein the titanium is in the form of particles of from 1 to 3 microns in diameter and the potassium perchlorate is in the form of particles less than 10 microns in diameter.

14. A method of detonating a high order explosive in operative association with a primer mix as defined in claim 1, which comprises subjecting the primer mix in a housing to impact of at least 4 ft.-lb. such that the energy released by deflagration of the primer mix causes the high order explosive to detonate.

15. A method of making a primer mix as defined in claim 1, which comprises mixing particles of titanium and potassium perchlorate in a ratio of from 26 to 66 weight percent titanium and from 74 to 44 weight percent potassium perchlorate; and compacting the mixture to a density of from 2.1 to 2.5 g/cc.

16. As an article of manufacture a primer mix, which consists essentially of from 26 to 66 weight percent titanium and from 74 to 44 weight percent potassium perchlorate, having a density of from 68 of 81 percent of crystal density.

17. A primer mix as defined in claim 16, wherein the density is from 75 to 81 percent of crystal density.

18. As an article of manufacture a primer mix, which consists essentially of from 40 to 70 percent zirconium and from 60 to 26 weight percent potassium perchlorate, having a density of from 68 to 81 percent of crystal density.

19. A primer mix as defined in claim 18, wherein the density is from 75 to 81 percent of crystal density.

* * * * *